US006301457B1

(12) United States Patent
Chadani et al.

(10) Patent No.: US 6,301,457 B1
(45) Date of Patent: Oct. 9, 2001

(54) COUPLING MEMBER, PROCESS CARTRIDGE AND IMAGE FORMING APPARATUS

(75) Inventors: Kazuo Chadani, Shizuoka-ken; Naoki Asano, Mishima, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/587,912

(22) Filed: Jun. 6, 2000

(30) Foreign Application Priority Data

Jun. 8, 1999 (JP) ..... 11-160472

(51) Int. Cl.[7] ..... G03G 15/00
(52) U.S. Cl. ..... 399/167; 399/106; 399/111
(58) Field of Search ..... 399/111, 167, 399/102, 103, 106, 36, 37, 88, 90

(56) References Cited

U.S. PATENT DOCUMENTS 4,998,140 * 3/1991 Satou et al. ..... 399/105
5,943,529 8/1999 Miyabe et al. ..... 399/111
5,966,567 10/1999 Matsuzaki et al. ..... 399/111
6,178,302 * 1/2001 Nagashima et al. ..... 399/106

FOREIGN PATENT DOCUMENTS 09-006214 * 1/1997 (JP) .
09-114352 * 5/1997 (JP) .

* cited by examiner

*Primary Examiner*—Sophia S. Chen
(74) *Attorney, Agent, or Firm*—Fitzpatrick, Cella, Harper & Scinto

(57) ABSTRACT

A rotatable coupling member is provided for transmitting driving forces to a first driver for driving a seal member for sealing an opening for discharging a developer from a developer accommodating container for accommodating the developer to unseal the opening and a second driver for driving a stirring member for stirring the developer in the developer accommodating container. The coupling member receives a driving force from a main assembly of an image forming apparatus to rotate in a first rotational direction to unseal the opening and to rotate in a second rotational direction, which opposite from the first rotational direction, to drive the second driver. The coupling member includes a first portion for substantially aligning a rotational center of the coupling member with a rotational center of a main assembly coupling member when the coupling member rotates in the first rotational direction, and a second portion for permitting deviation between the rotational center of the coupling member and the rotational center of the main assembly coupling member.

23 Claims, 13 Drawing Sheets

COUPLING MEMBER, PROCESS CARTRIDGE AND IMAGE FORMING APPARATUS

FIELD OF THE INVENTION AND RELATED ART

The present invention relates to a coupling member and a process cartridge, which are usable for an image forming apparatus. It also relates to an image forming apparatus.

In this specification, the term "image forming apparatus" refers to an apparatus for forming an image on a recording medium, using a given image forming method, preferably, an electrophotographic image forming method. As for examples of such an image forming apparatus, there are electrophotographic copying machines, electrophotographic printers (laser beam printers, LED printers, and the like), facsimile apparatuses, word processors, and the like.

The term "process cartridge" refers to a cartridge that is removably installable in the main assembly of an image forming apparatus, and in which at least one means among a charging means, a developing means, and a cleaning means, and an image bearing member, are integrally disposed.

Conventionally, an image forming apparatus that employs an electrophotographic image formation process also employs a process cartridge system, according to which an electrophotographic photosensitive member as an image bearing member, and one or a plurality of processing means that act on the electrophotographic photosensitive member, are integrated into the form of a cartridge, which is removably installable in the main assembly of an image forming apparatus. Also according to this process cartridge system, an image forming apparatus can be maintained by a user alone, without relying on a service person, drastically improving operational efficiency. Therefore, the process cartridge system has been widely used in the image-forming-apparatus field.

A process cartridge such as the one described above comprises one or a plurality of processing means. One of such processing means is a developing means, which integrally comprises a developer storage container (toner container) in which toner is stored, and a developing means frame for supporting a developing member. Until a process cartridge is put to use for the first time, the passage between the toner container and developing means frame remains sealed with a sealing member (toner seal). This sealing member is torn open when a process cartridge is put to use for the first time.

It is common knowledge that some process cartridges or electrophotographic image forming apparatuses (hereinafter, "image forming apparatus"), are provided with a driving force transmitting means for receiving the driving force from the main assembly of an image forming apparatus to automatically wind up the sealing member to tear open it.

The sealing member winding driving force transmitting means of a conventional image forming apparatus, process cartridge, or toner container, is structured so that as the winding of the sealing member ends, it must stop transmitting the driving force, or it shuts down. Therefore, an apparatus main assembly, process cartridge, or toner container, must be provided with a driving force transmitting means dedicated to the winding of a sealing member. Further, in many image forming apparatus main assemblies, a toner seal winding unit and a toner stirring unit are simultaneously driven.

Such an arrangement complicates the driving means on the apparatus main assembly side. Further, the simultaneous driving of the stirring unit and toner seal winding unit leads to increase in power consumption.

The present invention is one of the results of the further development of the above described conventional technologies.

As a means for solving the above-described problems, it was conceivable to divide a driving force transmitting portion into a two portions, that is, a portion for transmitting a driving force to a photosensitive drum and a toner stirring member, and a portion for transmitting a driving force to a sealing-member winding unit, and to begin driving the photosensitive drum and toner stirring member after finishing driving the toner-seal winding unit. In addition to the above-described problems, the conventional structure suffers another problem. That is, when a sealing member begins to be wound, the process cartridge is yet to be securely positioned relative to the apparatus main assembly, and therefore, while the sealing member is wound to be torn open, the process cartridge is sometimes caused to vibrate by the driving force from the image-forming-apparatus main assembly.

As the process cartridge vibrates, the coupling member on the process cartridge side, through which the electrophotographic photosensitive drum is driven by the driving force from the image forming apparatus main assembly, fails to align with the coupling member on the image forming apparatus main assembly side, making it difficult for the coupling member on the cartridge side to be inserted into the coupling member on the main assembly side.

SUMMARY OF THE INVENTION

The primary object of the present invention is to provide a driving force transmitting coupling member, a process cartridge, and an image forming apparatus, which make it possible to approximately fix the positional relationship between a driving force transmitting coupling member and a coupling member on the main assembly side when the driving force transmitting coupling member transmits driving force to a driving means for tearing open a sealing member.

Another object of the present invention is to provide a driving force, transmitting-coupling member, a process cartridge, and an image forming apparatus, that make it possible to virtually unfix the previously fixed positional relationship between a driving-force, transmitting-coupling member and a coupling member on the main-assembly side when a driving-force, transmitting-coupling member transmits a driving force to a stirring member.

Another object of the present invention is to provide a coupling member for driving a driving means which does not cause a process cartridge to vibrate when a sealing member is torn open, and allows the coupling member on the image forming apparatus main assembly side to easily engage with the coupling member of an image bearing member after the completion of the tearing of the sealing member, and driving a driving means for a stirring member, a process cartridge comprising such a coupling member, and an image forming apparatus in which such a process cartridge is removably installable.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Hereinafter, preferred embodiments of the present invention will be described with reference to FIGS. 1 and 2.

Description of Process Cartridge and Image Forming Apparatus Main Assembly

Figure 1:
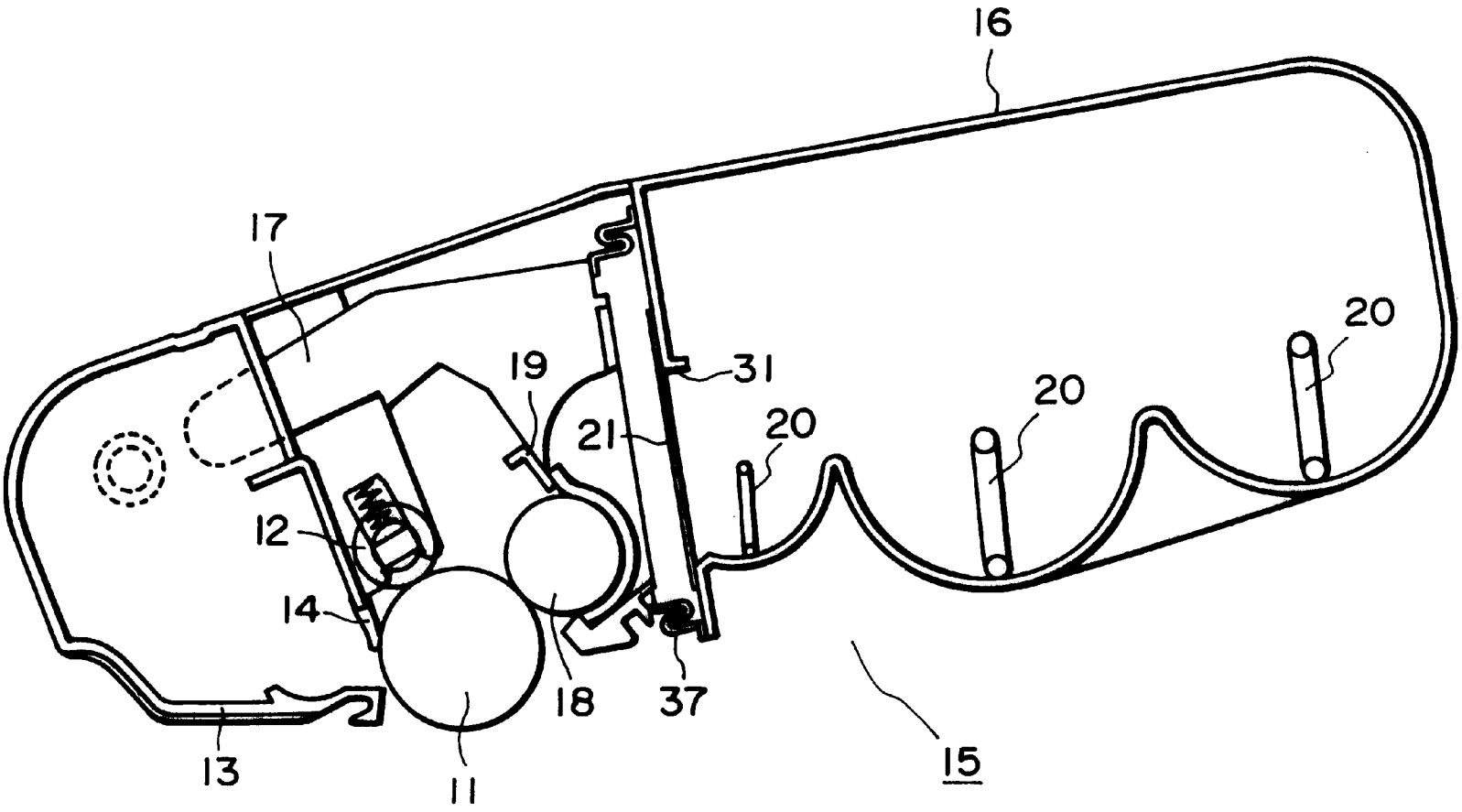
FIG. 1 is a schematic sectional view of the essential portion of the process cartridge in the preferred embodiment of the present invention, at a plane perpendicular to the longitudinal direction of the cartridge.

FIG. 1 illustrates a cross section of the essential portion of a process cartridge in accordance with the present invention, at a plane perpendicular to the longitudinal direction of the cartridge. FIG. 2 illustrates a cross section of the essential portion of an image forming apparatus in accordance with the present invention, at a plane perpendicular to the longitudinal direction of the process cartridge. This process cartridge is provided with an image bearing member and one or a plurality of processing means which act on the image bearing member. As for the processing means, there are, for example, a charging means for charging the peripheral surface of the image bearing member, a developing apparatus for forming a toner image on the image bearing member, and a cleaning means for removing the toner remaining on the peripheral surface of the image forming apparatus. The process cartridge is provided with an electrophotographic photosensitive member as the image bearing member, and at least one processing means among the above listed processing means.

Referring to FIG. 1, in the case of the process cartridge 15 in this embodiment, a charging roller 12 as the charging means, a development roller 18 and a development blade, which constitute the developing apparatus, a toner storage frame 16 as a developer storage container in which toner as developer is stored, a stirring member 20 as a rotational member for stirring the toner in the toner storage frame 16, a cleaning blade 14 as the cleaning means, and an electrophotographic photosensitive drum 11, along the peripheral surface of which the preceding processing means are disposed, are integrally disposed in a housing to form the process cartridge 15 removably installable in the main assembly of an image forming apparatus.

Figure 2:
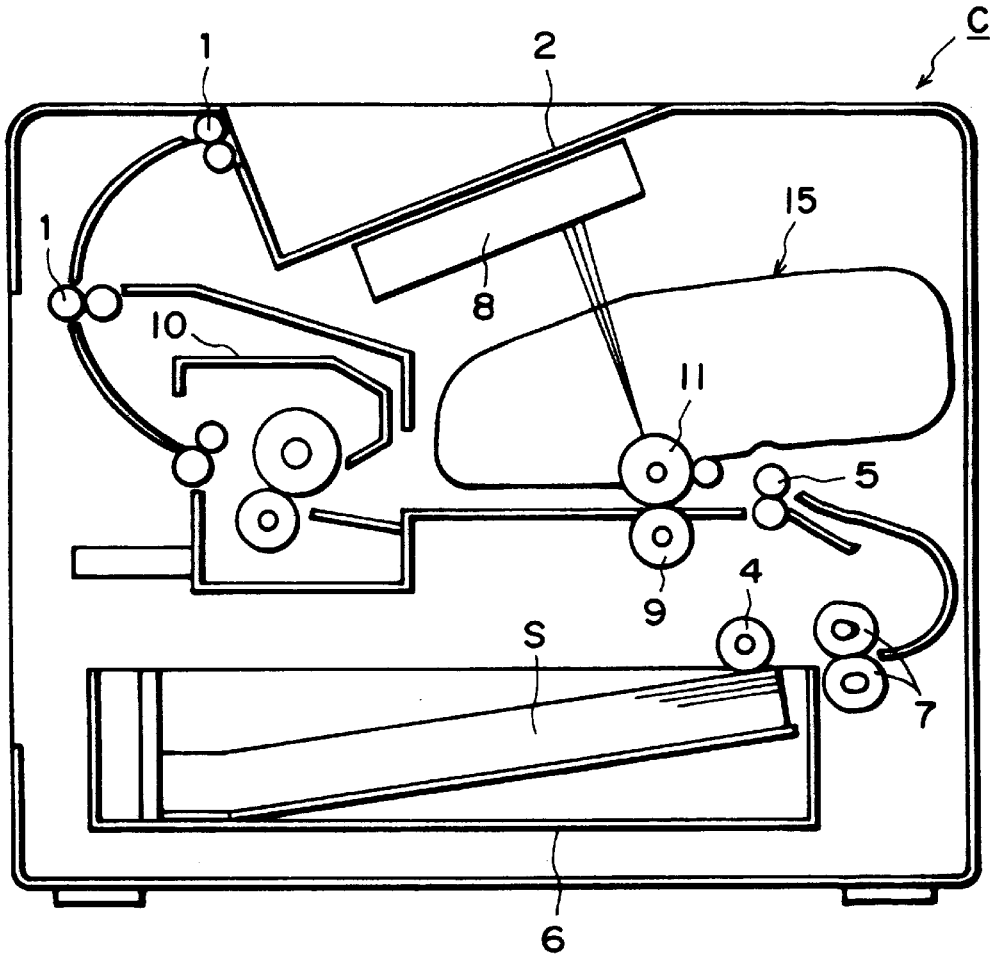
FIG. 2 is a schematic sectional view of the essential portion of the image forming apparatus in the preferred embodiment of the present invention, at a plane perpendicular to the longitudinal direction of the process cartridge.

This process cartridge 15 is installed into an image forming apparatus C illustrated in FIG. 2 to be used for image formation, which is carried out through the following steps. First, a sheet S is conveyed to an image transfer location adjacent to the peripheral surface of the photosensitive drum 11, from a sheet cassette 6 installed in the bottom portion of the image forming apparatus C, by a pickup roller 4, a pair of conveyer rollers 7, and a registration roller 5. Meanwhile, the photosensitive drum 11 is selectively exposed to light modulated with image information by an exposing apparatus 8 after being charged by the charge roller 12. As a result, an electrostatic latent image is formed. The exposure by the exposing apparatus 8 is carried out in synchronism with the sheet conveyance by the registration roller 5. After the formation of the electrostatic latent image, the toner that has been delivered into the developing means frame 17 from the toner-storage frame 16 is coated in a thin layer on the peripheral surface of the development roller 18 by the development blade 19. As a development bias is applied to the development roller 18, the toner is supplied from the development roller 18 to the photosensitive drum 11 in a pattern corresponding to the pattern of the electrostatic latent image, forming a toner image on the photosensitive drum 11. This toner image is transferred onto the sheet S, which is being conveyed, by applying a bias (voltage) to the transfer roller 9 at the transfer location. Thereafter, the sheet S is conveyed to a fixing apparatus 10, in which the toner image is fixed to the sheet S, and then, the sheet S is discharged by a pair of discharge rollers 1, into a delivery portion 2 located at the top of the image forming apparatus.

Frame Structure of Process Cartridge

Figure 6:
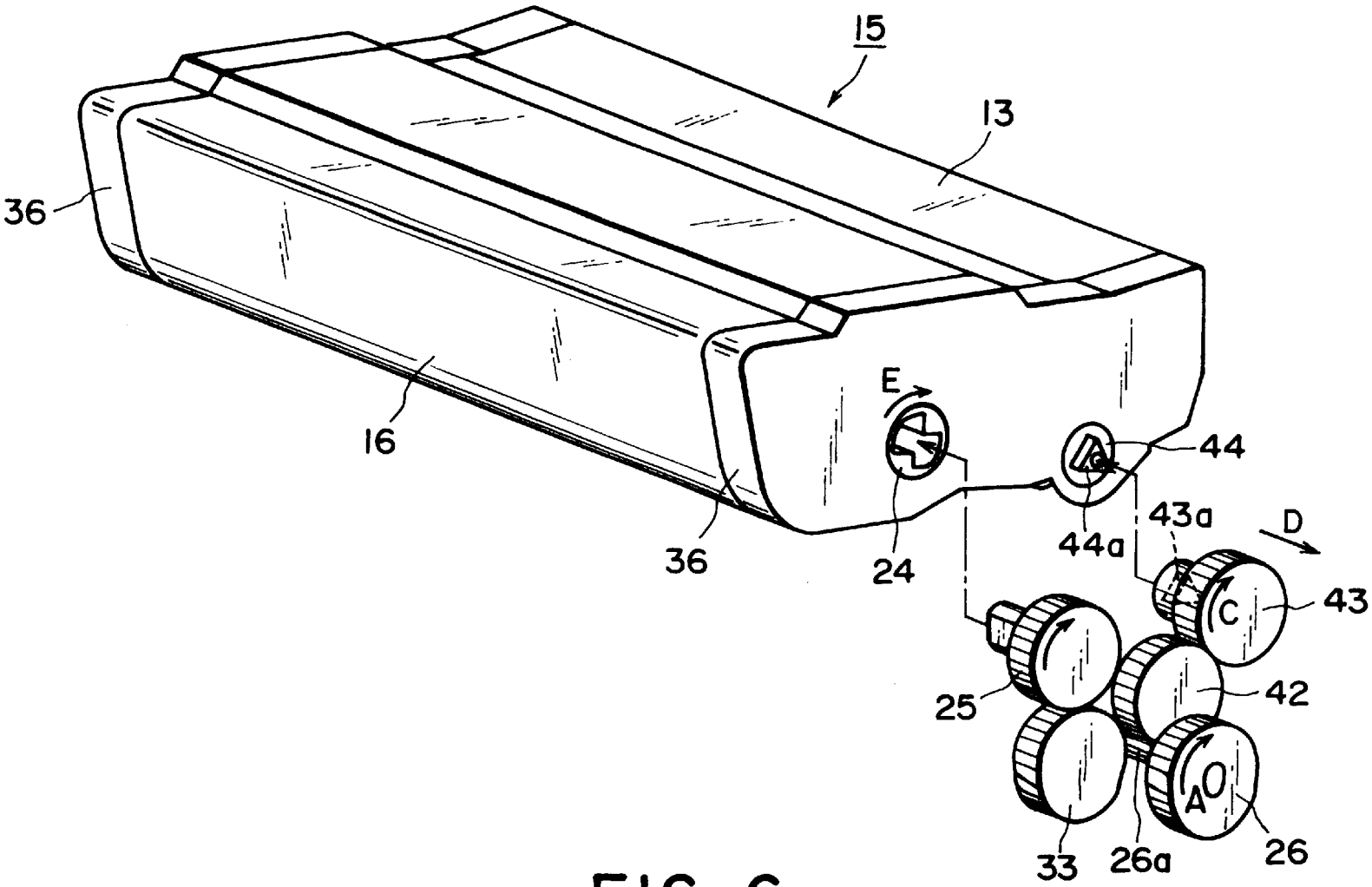
FIG. 6 is a schematic perspective view of the process cartridge in the first embodiment, when the toner seal is being wound.

Referring to FIG. 1, the above described process cartridge 15 comprises the toner storage frame 16, the developing means frame 17, and the cleaning means frame 13, which are sandwiched by a pair of side covers 36 as shown in FIG. 6. The toner storage frame 16 contains the toner stirring member 20, and the toner delivery opening 31 of which is sealed with a toner sealing member 21. The developing means frame 17 supports the development roller 18 and development blade 19. The cleaning means frame 13 supports the cleaning blade 14, and also pivotally supports the developing means frame 17. The side covers 36 cover the entire longitudinal ends of the toner storage frame 16, developing means frame 17, and cleaning means frame 13.

The toner storage frame 16 and developing means frame 17 are connected to each other, with the toner delivery opening 31 of the toner storage frame 16 and the toner receiving opening of the developing means frame 17 connected by a flexible sealing member 37, forming an airtight passage between the two frames 16 and 17.

Description of Tearing of Toner Seal and Driving of Stirring Member

Figure 3:
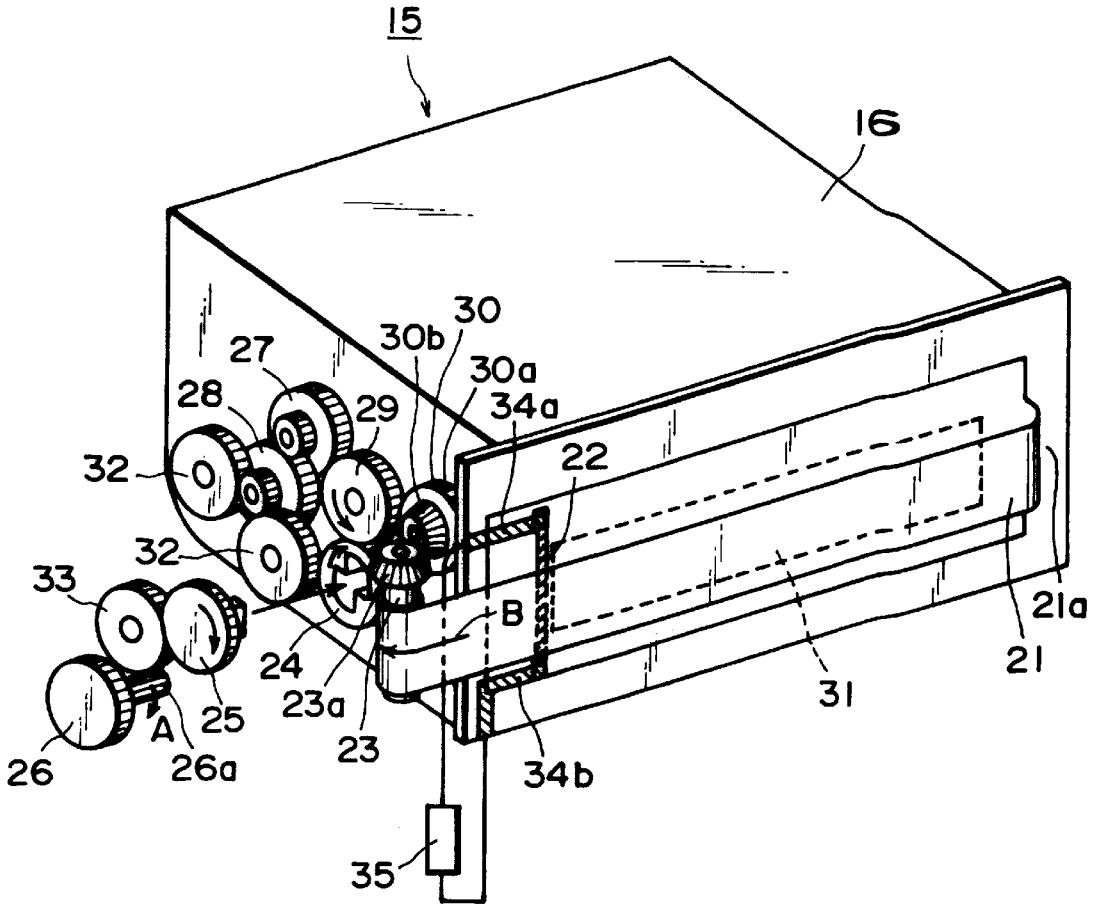
FIG. 3 is a schematic perspective view of the toner storage container of the process cartridge in the first embodiment of the present invention which is in the brand-new condition.
Figure 4:
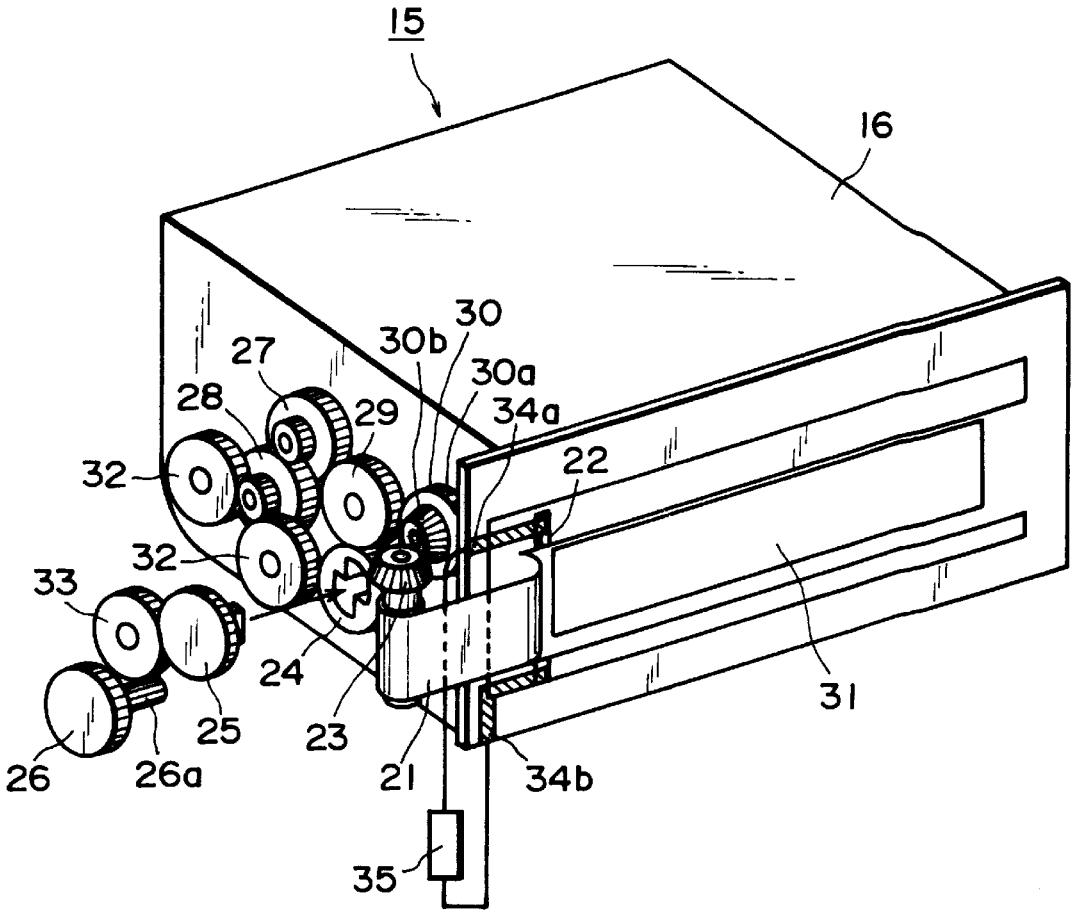
FIG. 4 is a schematic perspective view of the toner storage container of the process cartridge in the first embodiment of the present invention, from which the toner seal has been wound away.
Figure 5:
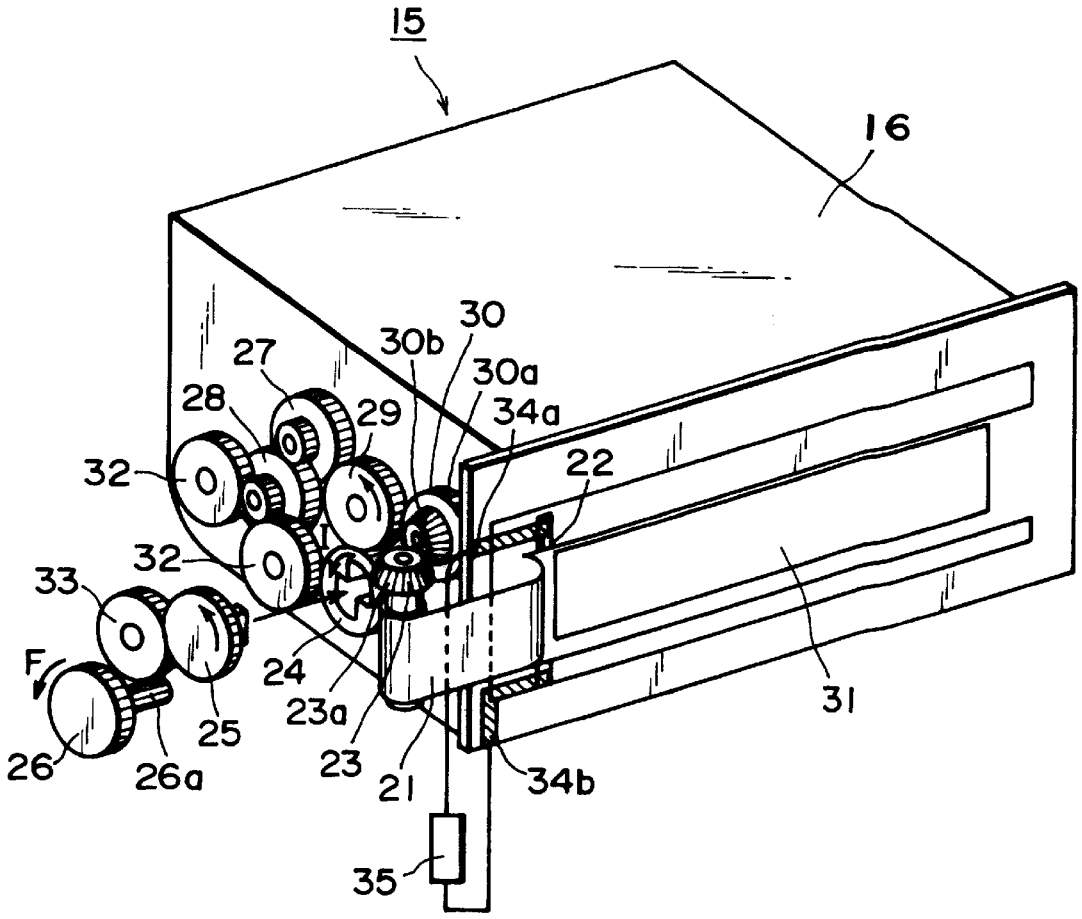
FIG. 5 is a schematic perspective view of the toner storage container of the process cartridge in the first embodiment, in which the toner stirring member has begun to be rotated.
Figure 7:
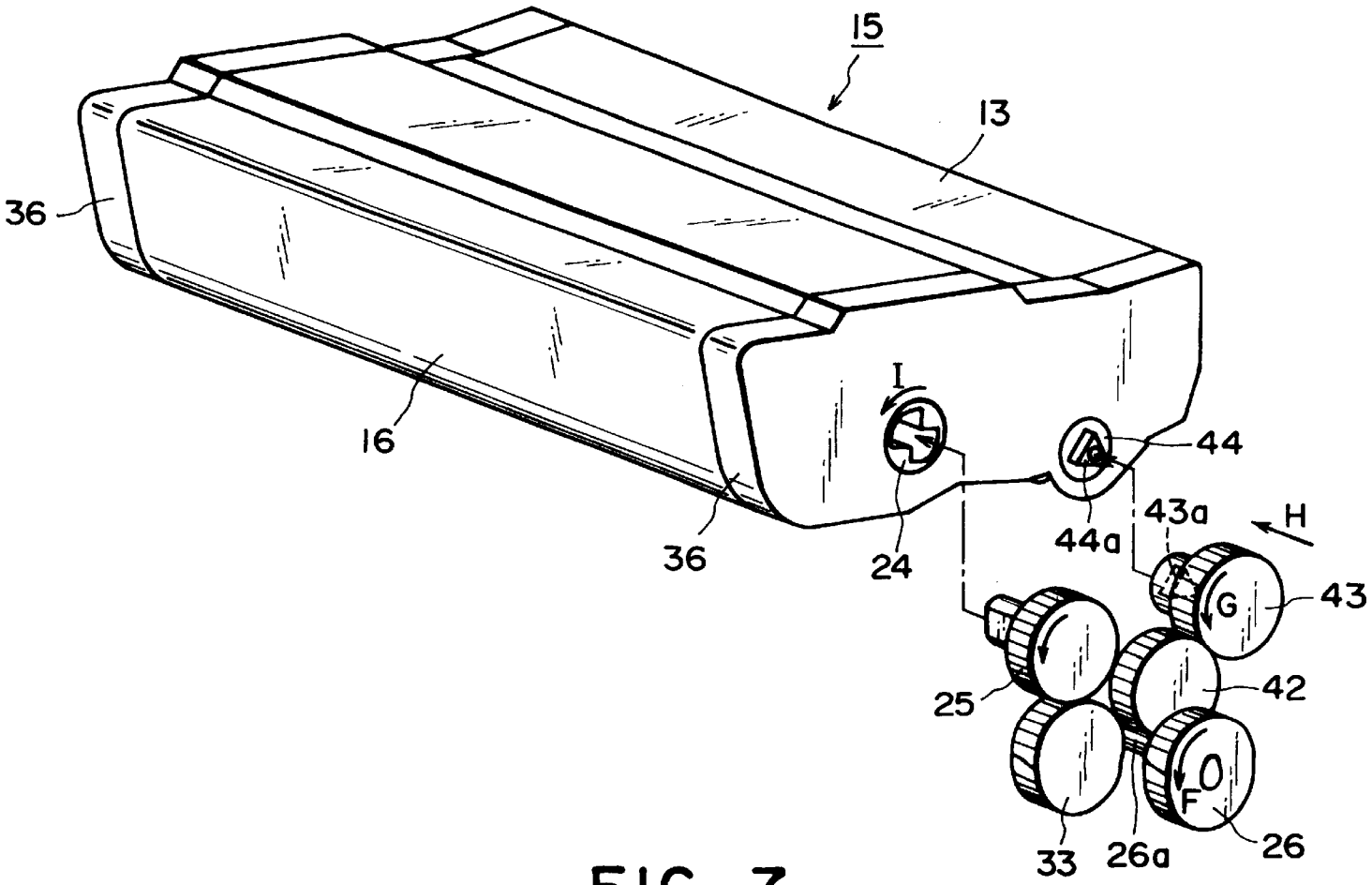
FIG. 7 is a schematic perspective view of the process cartridge in the first embodiment, when the photosensitive drum and stirring member are being rotated.

FIGS. 3 to 5 depict the toner storage frame in accordance with the present invention, and FIGS. 6 and 7 depict the process cartridge and the gear train within the image forming apparatus main assembly. Referring to FIG. 3, in the case of a brand-new process cartridge, the opening 31 of the toner storage frame 16 for supplying toner into the developing means frame 17 is covered with the toner sealing member 21, which is welded or glued to the toner storage frame 16 in a manner to cover the opening 31. The one end 21*a* of the toner sealing member 21 is folded back at a line slightly outward beyond the welding line, is extended back across the opening 31, and is fixed to the round shaft of a winding member rotatably supported by the toner storage frame 16. The width of the folded-back portion of the toner sealing member 21 is narrower than the width of the portion of the toner sealing member 21 welded or glued to the toner storage frame 16 in a manner to cover the opening 31.

The toner sealing member 21 is provided with an electrically conductive portion 22, which is laid across the electrically nonconductive polyethylene terephthalate portion of the toner sealing member 21, to detect whether or not the opening 31 has been entirely exposed; the conductive portion 22 is laid across the downstream side of the toner sealing member 21 in terms of the direction in which the toner sealing member 21 is torn. In this embodiment, the conductive portion 22 is a piece of aluminum foil pasted to the toner sealing member, across the downstream side of the toner sealing member 21 in terms of the tearing direction of the toner sealing member 21. Across this conductive portion 22, voltage is applied from the detecting portion of the image forming apparatus main assembly. More specifically, the process cartridge 15 is provided with a metallic plate equipped with a pair of contacts 34*a* and 34*b*, and the voltage is applied to the conductive portion 22 through this metallic plate.

As the process cartridge 15 in the brand-new condition is installed into the image forming apparatus main assembly, the detecting portion 35 and conductive portion 22 are electrically connected through the contacts 34*a* and 34*b*. Thus, until the toner sealing member 21 is almost completely wound up, electrical current is allowed to conduct through the conductive portion 22, and is detected by the detecting portion 35 of the image forming apparatus main assembly. Upon detection of this current flow through the conductive portion, a motor 26 provided as a driving force source on the image forming apparatus main assembly side begins to rotate in the direction indicated by an arrow mark A.

Referring to FIG. 6, the image forming apparatus main assembly is provided with the motor 26, an idler gear 42, a first coupling 43, an idler gear 33, and a second coupling 25.

Referring to FIGS. 3 and 6, as the motor 26 rotates in the direction of the arrow mark A, a motor gear 26*a*, integral with the output shaft of the motor 26, rotates. Upon receiving the rotational force transmitted from the motor gear 26*a* through the idler gear 42, the first coupling 43 in the image-forming-apparatus main assembly moves in the direction of an arrow mark D while rotating in the direction of an arrow mark C, without coupling with the first driving-force transmission coupling 44, with which one of the longitudinal ends of the photosensitive drum 11 in the process cartridge 15 is provided. Therefore, the photosensitive drum 11 does not rotate in the direction reverse to the normal direction. The second driving-force transmission coupling gear 24 in the process cartridge 15 receives a driving force by engaging with the second coupling 25 on the image-forming-apparatus-main-assembly side, to which the driving force is transmitted from the motor 26 of the image-forming-apparatus main assembly through the idler gear 33. The second driving-force transmission coupling gear 24 transmits the driving force to an oscillatory gear 29, with which the process cartridge 15 is provided, and which is illustrated in FIG. 3, which shows the toner-storage frame 16 from which the pair of side covers 36 have been removed. Upon the transmission of the driving force to this oscillatory gear 29, the oscillatory gear 29 moves toward the idler gear 30, and meshes therewith, transmitting thereby the driving force thereto. As a result, the gear 23*a* of the winding member 23, which meshes with the idler gear 30, rotates, causing the toner sealing member 21 to be wound in the direction of an arrow mark B. At this point, the oscillatory gear 29 is not in meshing engagement with an oscillatory idler gear 27; there is a gap between the two oscillatory gears.

The oscillatory gear 29 is rotatably supported by the end portion of an unillustrated oscillatory arm axially attached to the toner storage frame 16, in such a manner that the center of the oscillatory gear 29 is on a line perpendicular to the line that connects the centers of the oscillatory idler gear 27 and idler gear 30. The oscillatory axis of the oscillatory arm coincides with the rotational axis of the second driving-force transmission coupling gear 24. When not in operation, the oscillatory gear is retained where it does not mesh with either of the oscillatory idler gear 27 and idler gear 30, by pulling the oscillatory arm with the use of a pair of springy members that pull the oscillatory arm in opposing directions. The oscillatory gear 29 meshes with the gear portion 24*g* (FIGS. 9 and 10), that is, the peripheral portion, of the second coupling gear 24. In other words, the inward portion of the second coupling 24 constitutes the actual coupling portion, and the peripheral portion of the second coupling gear 24 constitutes the gear portion 24*a*.

Thus, as the second coupling gear 24 rotates in the clockwise direction as shown in FIG. 3, the oscillatory gear 29 pivots about the same axis as the second coupling gear 24 due to the tooth load between the gear portion 24*a* of the second coupling gear 24, and the oscillatory gear 29, and meshes with the idler gear 30 which drives the winding gear 23*a*. As the second coupling gear 24 stops, the oscillatory gear 29 is retracted from the idler gear 30 by the aforementioned springy members; the meshing between the oscillatory gear 29 and idler gear 30 is disengaged.

Referring to FIG. 5, as the second coupling gear 24 rotates in the counterclockwise direction (direction of arrow mark I), the oscillatory gear 29 pivots about the same axis as the second coupling gear 24 due to the tooth load between the gear portion 24*g* of the second coupling gear 24 and the oscillatory gear 29, and meshes with the oscillatory idler gear 27 for transmitting the driving force to the stirring gear 32.

The oscillatory idler gear 27 is a compound gear integrally comprising a pair of gears different in diameter, the smaller of which meshes with an idler gear 28. The idler gear 28 is also a compound gear integrally comprising a pair of gears different in diameter, the smaller of which meshes with the stirring gear 32.

The idler gears 27 and 28, and the stirring gear 32, are individually and rotatably attached to one of the side walls of the developing means frame 17. The stirring gear 32 is connected to the toner stirring member 20.

The above does not means that the means for changing the direction in which the oscillatory gear 29 pivots, in accordance with rotational direction in which the coupling gear 24 rotates, is limited to the above described means.

The idler gear 30 is rotatably supported by the toner storage frame 16 of the process cartridge 15. The idler gear 30 is a compound gear integrally comprising a spur gear 30*a*, with or from which the oscillatory gear 29 engages or disengages, and a bevel gear 30*b*, which meshes with the bevel gear 23*a* integral with the winding member 23.

Referring to FIG. 4, as the toner sealing member 21 is wound in the direction of the arrow mark B, the conductive portion 22 is severed after the opening 31 is fully exposed. Consequently, the electrical connection between the contacts 34*a* and 34*b* is lost. Referring to FIG. 5, as this severed state of the conductive portion, that is, a state in which the electrical connection between the contacts 34*a* and 34*b* has been lost, is detected by the detecting portion 35 of the image forming apparatus main assembly, the CPU (FIG. 12) of the image forming apparatus main assembly controls the motor driving portion so that the motor 26, which has been supplying the second coupling 25 on the main assembly side with the force for driving the winding member 23, rotates in reverse. Next, referring to FIG. 7, as the motor 26 rotates in reverse, that is, in the direction of an arrow mark F, the first coupling 43 on the image-forming-apparatus-main-assembly side moves in the direction of the arrow mark H while remaining in mesh with the idler gear 42 and rotating in the direction of an arrow mark G, couples with the first driving force transmission coupling 44, with which one of the longitudinal ends of the photosensitive drum 11 in the process cartridge 15 is provided, and rotates while remaining coupled with the first driving force transmission coupling 44, to transmit the driving force to the photosensitive drum 11.

Referring back to FIG. 5, the second driving force transmission coupling 24 in the process cartridge 15 also rotates in reverse. As a result, the oscillatory gear 29 moves away from the idler gear 30, becoming disengaged therefrom, and engages with the oscillatory idler gear 27, causing the oscillatory idler gear 27 to rotate, which in turn transmits, through the idler gear 28, the driving force to the stirring gear 32 for rotating the stirring member 20 in the toner storage frame 16 shown in FIG. 1.

Description of Driving Force Transmitting Method and Coupling Members

Here, referring to FIGS. 8 to 10, the configurations of the couplings will be described.

Figure 8:
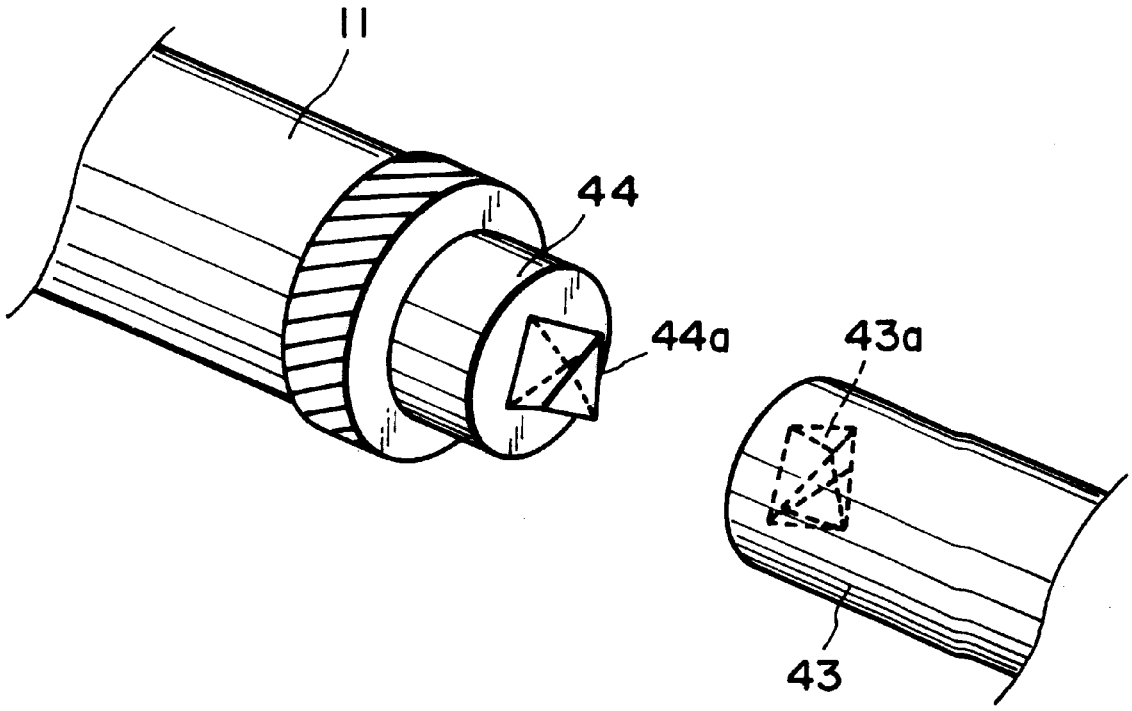
FIG. 8 is a schematic perspective view of the first coupling of the process cartridge, and the first coupling of the image forming apparatus main assembly, in the first embodiment.

Referring to FIG. 8, the first driving force transmission coupling 44 is provided with a projection 44*a* which is approximately in the form of a triangular prism, more specifically, a triangular prism twisted about its rotational axis in its rotational direction. The first coupling 43 on the main assembly side is provided with a recess which is approximately in the form of a triangular prism twisted about its rotational axis, and in which the projection 44*a* engages. With this arrangement, as the first driving force transmission coupling 44 fits into the first coupling 43 on the main assembly side, and is rotated thereby, the edges of the projection 44*a* make contact with the interior surfaces of the recess 43*a*, one for one, simultaneously and in the same manner. Therefore, the axial lines of the two couplings become aligned with each other while transmitting driving force.

Since the coupling portion of the first coupling 44, and the coupling portion of the coupling 43 on the main assembly side, are constituted of a projection and a recess, respectively, in the form of a twisted triangular prism, the rotation of the first coupling 44 after its engagement with the coupling portion 43 generates thrust in their axial direction. More specifically, referring to FIG. 6, as the first coupling 43 on the main assembly side rotates in the direction of the arrow mark C, it is moved in the direction of the arrow mark D. Referring to FIG. 7, as the first coupling 43 on the main assembly side rotates in the direction of the arrow mark G after its engagement with the first coupling 44, it is moved in the direction of the arrow mark H by being pulled by the first coupling 44 because of their twisted shape.

As is evident from the above description, as the first coupling on the main-assembly side rotates in the direction of the arrow mark C, it does not remain engaged with the first coupling 44, and therefore, the two couplings are not positioned relative to each other in any specific manner. On the other hand, as the first coupling 43 on the main-assembly side rotates in the direction of the arrow mark G, it engages with the first coupling 44, with a progressively increasing margin, while establishing a proper positional relationship relative to the first coupling 44.

Figure 9:
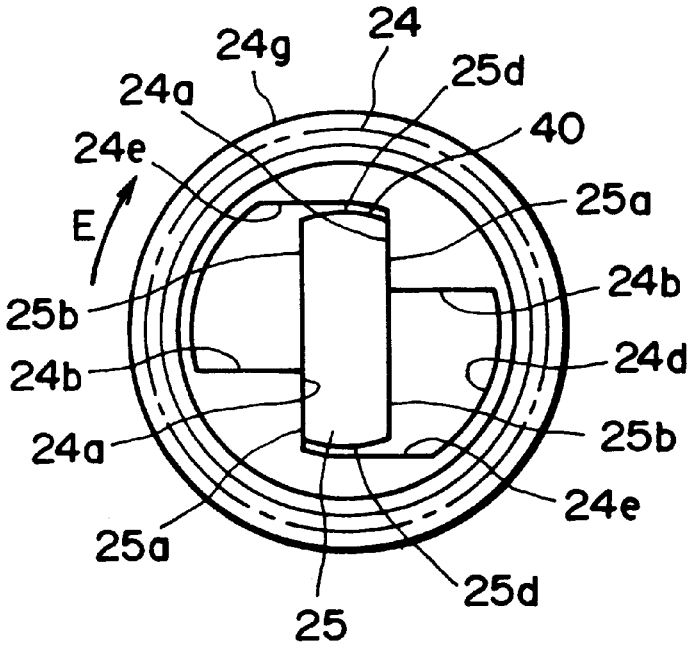
FIG. 9 is a sectional view of a combination of the second coupling of the process cartridge and the second coupling of the image forming apparatus main assembly, in the first embodiment, at a plane perpendicular to the axial lines of the two coupling members, when the two couplings are rotating in the direction to tear open the toner seal.
Figure 10:
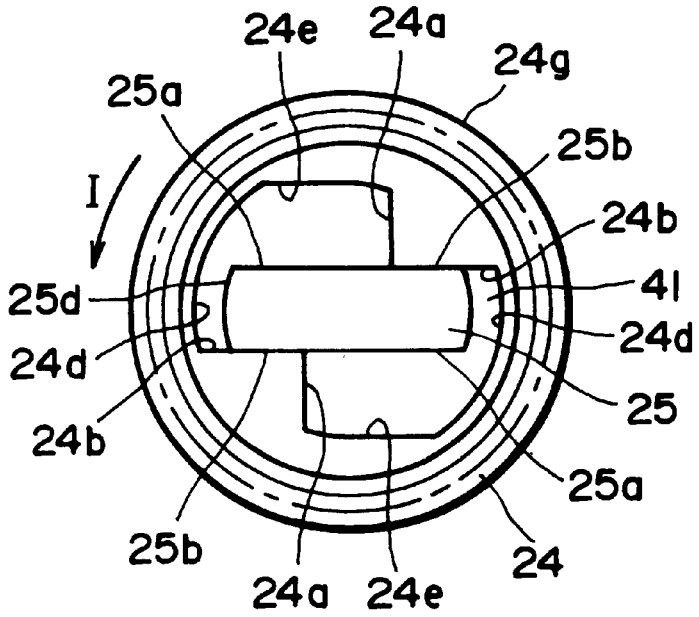
FIG. 10 is a sectional view of a combination of the second coupling of the process cartridge and the second coupling of the image forming apparatus main assembly, in the first embodiment, at a plane perpendicular to the axial lines of the two coupling members, when the two couplings are rotating in the direction to drive the stirring member.

Next, referring to FIGS. 9 and 10, the second coupling 25 on the image forming apparatus main assembly side is provided with a projection in the form of a flatted round column, and the portions adjacent to the two parallel edges of each of the pair of flat surfaces of this projection constitute a pair of contact portions 25*a* and 25*b*. The contact portions 25*a* and 25*b* on one of the flat surfaces are symmetrical in position and size to those on the other flat surface with respect to the axial line of the second coupling 25. On the other hand, the second coupling gear 24 in the process cartridge 15 is provided with a cylindrical recess 24*d*, and the wall of the cylindrical recess 24 is provided with an opposing pair of right-angled ribs. The surfaces of each rib, which are perpendicular to each other, constitute flat contact portions 24*a* and 24*b*.

Referring to FIG. 9, as the second coupling 25 on the main assembly side rotates in the recess 24*d* of the second coupling gear 24, in the direction of an arrow mark E to tear open the toner seal, the contact portions 24*a* of the angular ribs of the second coupling gear 24 and the contact portions 25*a* of the coupling 25 come into contact with each other, whereby the driving force is transmitted.

Also referring to FIG. 9, in order to reduce the gap 40, which is formed between the surface of the recess 24*d* of the second coupling gear 24 and the corresponding curved surface of the projection of the second coupling 25 on the main-assembly side, in terms of the radial direction of the two couplers 24 and 25, as the second coupling 25 on the main-assembly side rotates in the recess 24*d* of the second coupling gear 24, in the direction of the arrow mark E to tear open the toner seal, and the contact portions 24*a* of the angular ribs of the second coupling gear 24 and the contact portions 25*a* of the coupling 25 come into contact with each other, the two portions 24*e* of the surface of the recess 24*d*, which oppose each other with respect to the axial line of the coupling 24, and face the opposing curved surfaces of the projection of the second coupling 25, one for one, after the contact between the corresponding contact portions of the couplers 24 and 25, are rendered greater in diameter, making these surfaces virtually parallel to the corresponding surfaces 24*b*.

In cross section, the pair of opposing curved portions 25*d* (surfaces) of the second coupling 25 on the main-assembly side, form an arc, which is included in a circle, the center of which coincides with the rotational axis of the second coupling 25 on the main-assembly side. Further, the two virtually flat surfaces 24*e* of the recess of the second coupling 24 are an equal distance away from the rotational axis of the second coupling 24.

In this embodiment, the gap between the second coupling gear 24, and the second coupling 25 on the main assembly side, in terms of the radial direction of the two couplings, is made to be approximately 0.5 mm. Next, referring to FIG. 10, as the driving for tearing open the toner sealing member 21 ends, the second coupling 25 on the main assembly side rotates in reverse in the direction of the arrow mark I, causing the contact portions 24*b* of the second coupling gear 24 to come in contact with the contact portion 25*b* of the second coupling on the main assembly side. As a result, the second coupling gear 24 is driven, and the driving force is transmitted to the toner stirring member 20. Further, the two couplings 25 and 24 are configured so that during this driving of the second coupling gear 24 in the direction of the arrow mark I by the second coupling 25 on the apparatus main assembly side, there will be a gap 41 between the two couplings in terms of the radial direction of their rotational axes. In this embodiment, this gap is approximately 2 mm.

With the provision of the above structural arrangement, while the toner sealing member 21 is torn open, the positions of the rotational axes of the second coupling 25 on the main assembly side and second coupling gear 24 are stabilized virtually in alignment with each other, without rotationally driving the photosensitive drum 11. During the period after the toner sealing member 21 is torn open, that is, during image formation, the rotational axis of the first coupling 44 with which the photosensitive drum 11 is provided, and the rotational axis of the first coupling 43 on the main assembly side, become the primary rotational axes, and therefore, even when the rotational axis of the second coupling 24 for transmitting the driving force to the stirring member 20, and the rotational axis of the second coupling 25 on the main assembly side, are deviated from each other, the aligning of these two axes does not occur. Thus, the driving force is transmitted to the second coupling for driving the stirring member 20, without interfering with the aligning of the rotational axis of the first coupling 43 on the main assembly side and the rotational axis of the first coupling 44. In other words, it is permitted that the rotational axis of the second coupling 44 and the rotational axis of the first coupling 43 become misaligned with each other.

Figure 11:
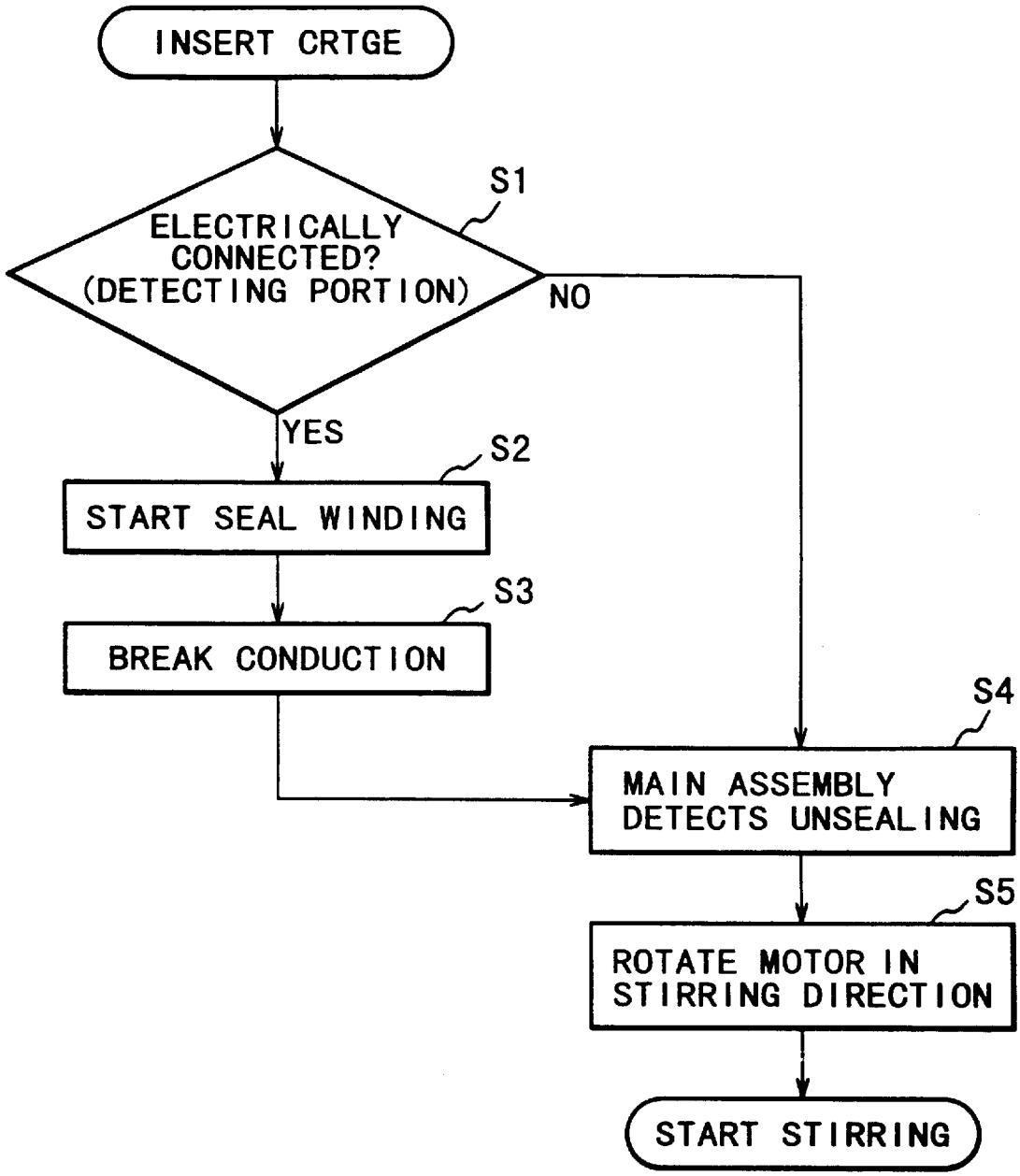
FIG. 11 is a flow chart for the first embodiment.
Figure 12:
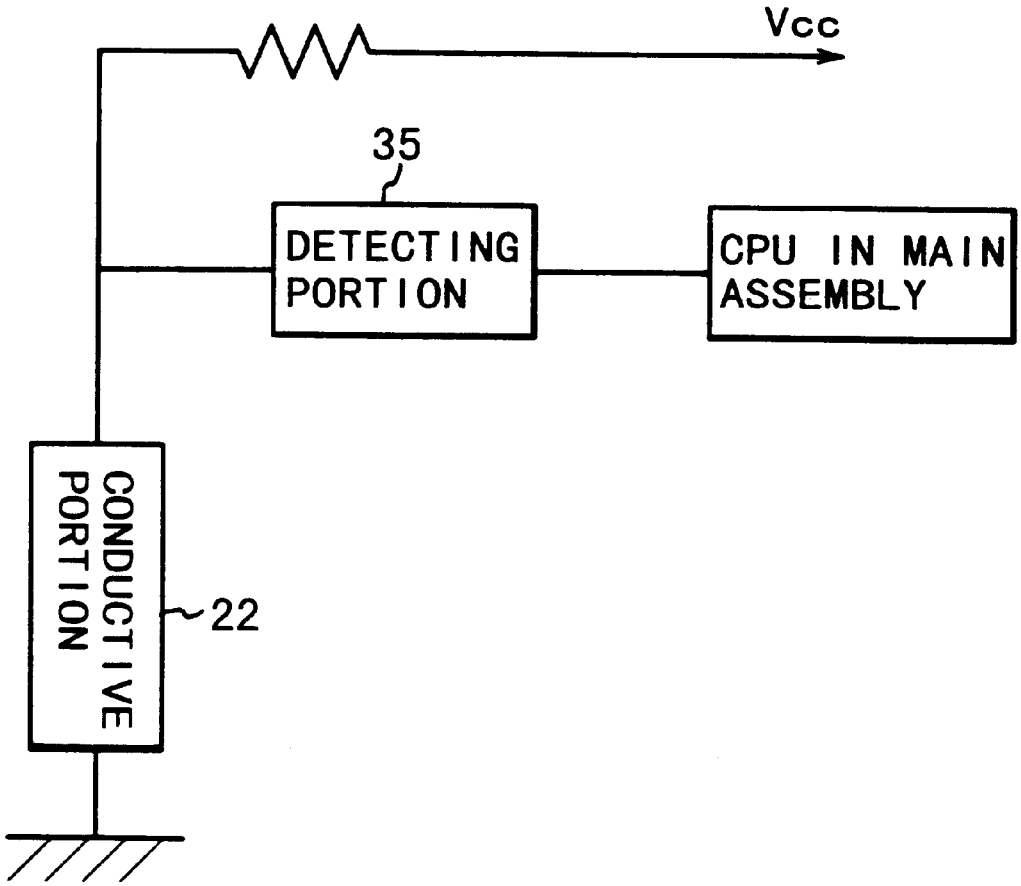
FIG. 12 is an abbreviated circuit diagram for the first embodiment.

The above described operation may be summarized in the form of a flow chart given in FIG. 11. FIG. 12 shows the abbreviated diagram of the circuit which controls the operation.

Upon installation of the process cartridge in this embodiment into the image forming apparatus, it is confirmed in step S1 whether or not current is allowed to flow through the conductive portion. When current flow is detected, step S2 is taken, in which the winding of the toner sealing member 21 is started. Next, in step S3, the tearing of the toner sealing member 21 continues, and eventually, the conductive portion 22 is severed. In step S4, the severing of the conductive portion 22 is detected, and therefore, it is determined that the tearing of the toner sealing member 22 has been completed. Next, in step S5, the motor 26 within the image forming apparatus main assembly is rotated in reverse to begin rotating the toner stirring member 20.

The detecting portion 35 comprises a DC power source and a current monitor. It applies voltage from the power source, and measures the current by the monitor to detect whether or not the toner sealing member 21 has been completely torn open.

Embodiment 2

Figure 13:
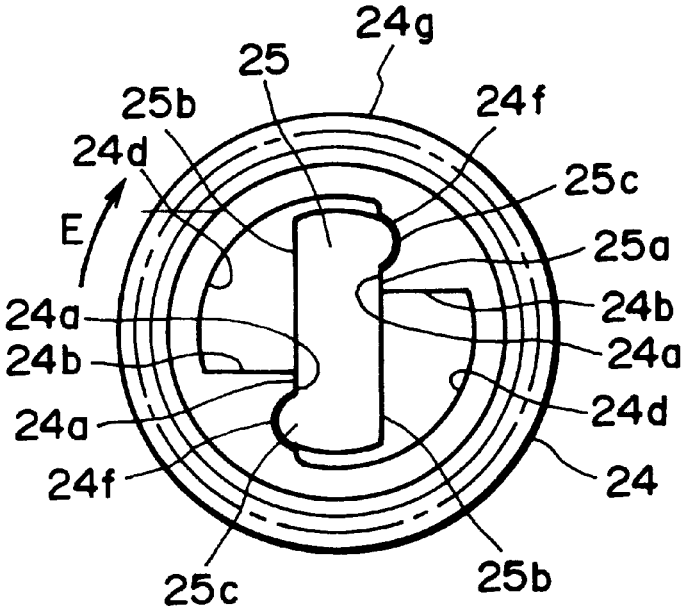
FIG. 13 is a sectional view of a combination of the second coupling of the process cartridge and the second coupling of the image forming apparatus main assembly, in the second embodiment, at a plane perpendicular to the axial lines of the two coupling members, when the two couplings are rotating in the direction to tear open the toner seal.
Figure 14:
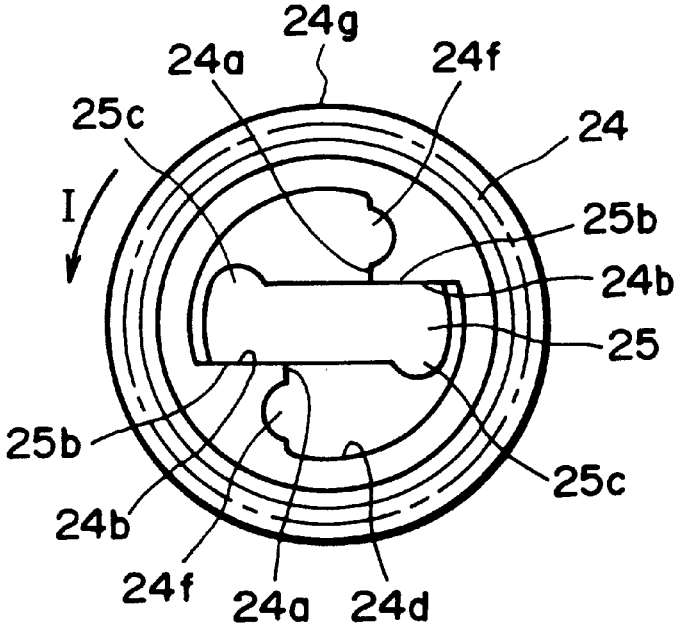
FIG. 14 is a sectional view of a combination of the second coupling of the process cartridge and the second coupling of the image forming apparatus main assembly, in the second embodiment, at a plane perpendicular to the axial lines of the two coupling members, when the two couplings are rotating in the direction to drive the stirring member.

Referring to FIGS. 13 and 14, this embodiment is different from the first embodiment in terms of the configuration of the contacting surfaces of the second coupling gear and the second coupling on the main assembly side. Otherwise, this embodiment is identical to the first embodiment. Thus, only the contact surfaces in this embodiment will be described below.

The second coupling 25 on the image forming apparatus main assembly side is provided with a projection in the form of a flatted round column. This projection is provided with a pair of ribs 25*c*, which are approximately semicircular in cross section, and symmetrical to each other with respect to the rotational axis of the second coupling 25 on the main assembly side. On the other hand, the second coupling 24 of the process cartridge 15 is provided with a cylindrical recess 24*d*, the cylindrical wall of which is provided with a pair of opposing, approximately right-angled ribs, which are symmetrical with respect to the rotational axis of the second coupling gear 24. These ribs are provided with contact portions 24*a* and 24*b*. The contact portions 24*a* and 24*b* of one of the ribs are symmetrical with the contact portions 24*a* and 24*b* of the other rib, with respect to the rotational axis of the second coupling 24. Both contact portions 24*a* are provided with a recess 24*f* which is approximately semicircular in cross section.

Referring to FIG. 13, as the second coupling 25 rotates in the direction of the arrow mark E, that is, the direction to tear open the toner seal, the ribs 25*c*, that is, the contact portions of the coupling 25, which are approximately semicircular in cross section, engage in the recesses 24*f* with which the angular ribs of the second coupling gear 24 are provided, and transmits the driving force.

As the second coupling gear 24 rotates in the direction of the arrow mark E, that is, the direction to tear open the toner sealing member 21, the ribs 25*c* which are approximately semicircular in cross section, and with which the coupling 25 on the main assembly side is provided, engages in the recesses 24*f* which are approximately semicircular in cross section, and with which the angular ribs of the second coupling gear 24 are provided. As a result, the movement of the two couplings 24 and 25 in the their radial direction relative to each other is regulated; the rotational axes of the coupling 24 and 25 are made to approximately align with each other.

As the ribs 25*c* engage into the recesses 24*f*, the contact portion 25*a* of the second coupling 25 on the main-assembly side comes into, and remains in, contact with the contact portion 24*a* of the second coupling gear 24, transmitting the rotational force, or the driving force, from the second coupling 25 on the main-assembly side to the second coupling gear 24. It should be noted here that instead of making the contact portions 24*a* and 25*a* contact each other, the surface of each rib 25*c* may be placed in contact with the surface of the corresponding recess 24*f*.

Referring to FIG. 14, after the completion of the drive for tearing open the toner sealing member 21, the second coupling 25 on the main assembly side is rotated in reverse in the direction of the arrow mark I, causing the contact portion 24*b* of the second coupling gear 24 to come into contact with the contact portion 25*b* of the second coupling 25 on the main assembly side. As a result, the second coupling gear 24 is driven to transmit the driving force to the stirring member 20.

Embodiment 3

Figure 15:
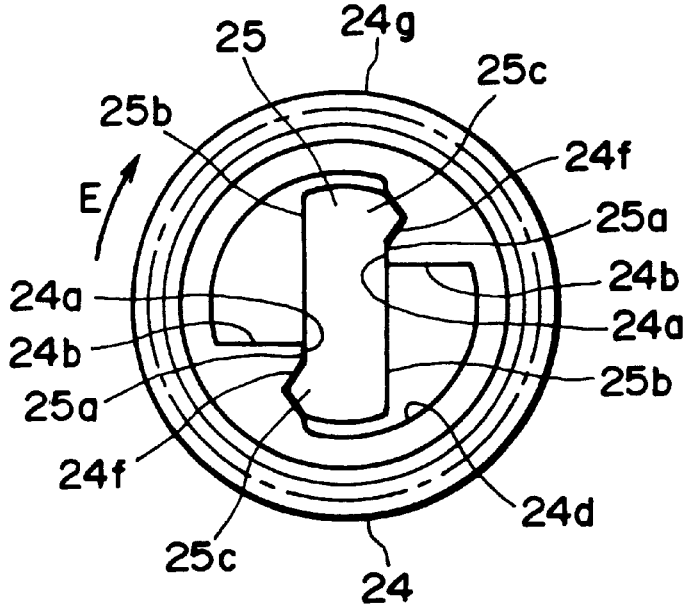
FIG. 15 is a sectional view of a combination of the second coupling of the process cartridge and the second coupling of the image forming apparatus main assembly, in the third embodiment, at a plane perpendicular to the axial lines of the two coupling members, when the two couplings are rotating in the direction to tear open the toner seal.
Figure 16:
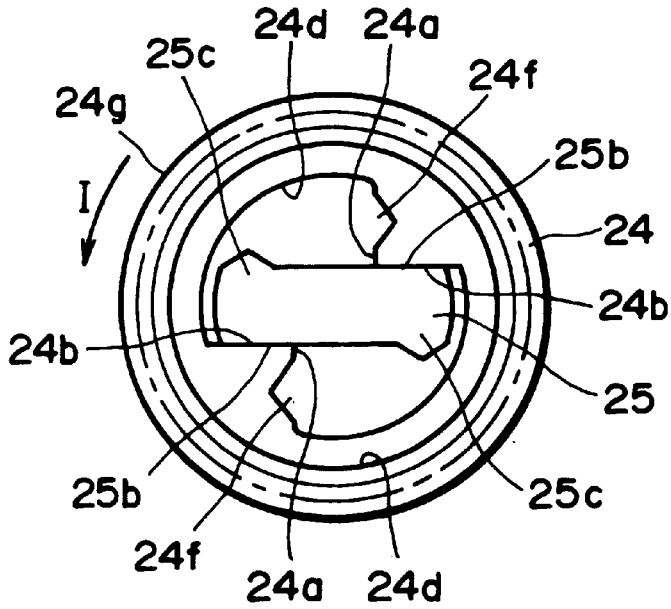
FIG. 16 is a sectional view of a combination of the second coupling of the process cartridge and the second coupling of the image forming apparatus main assembly, in the third embodiment, at a plane perpendicular to the axial lines of the two coupling members, when the two couplings are rotating in the direction to drive the stirring member.

Referring to FIGS. 15 and 16, the second coupling gear, and the second coupling gear on the main assembly side, in this embodiment, which will be described below, are different in configuration from those in the second embodiment. Otherwise, this embodiment is identical in configuration to the second embodiment. More specifically, while the coupling portions in the second embodiment are approximately semicircular in cross section, the coupling portions in this third embodiment are rendered approximately triangular in cross section.

The second coupling 25 on the image forming apparatus main assembly side is provided with a projection in the form of a flatted round column. This projection is provided with a pair of ribs 25*c* which are approximately triangular in cross section. The second coupling gear 24 within the process cartridge 15 is provided with a cylindrical recess 24*d*, the cylindrical wall of which is provided with a pair of ribs, which are approximately triangular in cross section, with the surfaces of each rib serving as contact portions 24*a* and 24*b*.

Referring to FIG. 15, as the second coupling 25 on the main assembly side is rotated in the direction of the arrow mark E, that is, the direction to tear open the toner sealing member 21, the ribs 25*c* of the second coupling 25 on the main assembly side engage into the recesses 24*f* of the second coupling gear 24, transmitting the driving force.

While the second coupling gear 24 is rotationally driven in the direction of the arrow mark E, that is, the direction to tear open the toner sealing member 21, the ribs 25*c* which are triangular in cross section, and with which the second coupling 25 on the main assembly side, engage into, and remain in, the recesses 24*f* which are triangular in cross section, and with which the second coupling gear 24 is provided. As a result, the movement of the second coupling gear 24 in terms of the radial direction is regulated, and the rotational axes of the two couplings 24 and 25 are virtually aligned, and remain aligned, with each other.

As the ribs 25*c* engage into the recesses 24*f*, the contact portion 25*a* of the second coupling 25 on the main-assembly side comes into, and remains in, contact with the contact portion 24*a* of the second coupling gear 24, transmitting the rotational force, or the driving force, from the second coupling 25 on the main-assembly side to the second coupling gear 24. It should be noted here that instead of making the contact portions 24*a* and 25*a* contact each other, the surface of each rib 25*c* may be placed in contact with the surface of the corresponding recess 24*f*.

Referring to FIG. 16, after the completion of the drive for tearing open the toner sealing member 21, the second coupling 25 on the main assembly side is rotated in reverse in the direction of the arrow mark I, causing the contact portion 24*b* of the second coupling gear 24 to come into contact with the contact portion 25*b* of the second coupling 25 on the main assembly side. As a result the second coupling gear 24 is driven to transmit the driving force to the stirring member 20.

As described regarding the first to third embodiments, according to the present invention, while the sealing member is torn open, the positional relationship between the second driving-force transmission coupling, and the second coupling on the main-assembly side, is virtually fixed, and remains virtually fixed, preventing a process cartridge from vibrating. Further, during this tearing of the toner sealing member, the first driving-force transmission coupling, and the first coupling on the main-assembly side, for transmitting a driving force to an image bearing member, are not engaged with each other, and therefore, it does not occur that the image-bearing member is rotated in reverse. In other words, during this period, the process cartridge is positioned at a position different from the position for image formation.

Further, when a driving force is transmitted to a stirring member, the first driving-force transmission coupling, and the first coupling on the main-assembly side, are engaged with each other, and are fixed in positional relationship relative to each other. Therefore, the process cartridge is prevented from vibrating. Also during this period, the process cartridge is placed in the position for image formation. Further, when the positional relationship between the first driving-force transmission coupling, and the first coupling on the main-assembly side, changes from the unengaged state to the engaged state, a certain amount of deviation is permitted between the rotational axis of the second driving-force transmission coupling, and the rotational axis of the second coupling on the main-assembly side. Therefore, the change of the positional relationship between the first driving-force transmission coupling, and the first coupling on the main-assembly side, from the unengaged state to the engaged state, is smooth.

While the invention has been described with reference to the structures disclosed herein, it is not confined to the details set forth, and this application is intended to cover such modifications or changes as may come within the purposes of the improvements or the scope of the following claims.

What is claimed is:

1. A rotatable drive transmission coupling member for transmitting driving forces to first driving means for driving a seal member for sealing an opening for discharging a developer from a developer accommodating container for accommodating the developer to unseal the opening and to second driving means for driving a stirring member for stirring the developer in the developer accommodating container, wherein said drive transmission coupling member receives the driving forces from a main assembly coupling member provided in a main assembly of an image forming apparatus to rotate in a first rotational direction to drive said first driving means and unseal the opening and to rotate in a second rotational direction which is opposite from the first rotational direction to drive said second driving means, said drive transmission coupling member comprising:

a first portion for substantially aligning a rotational center of said drive transmission coupling member with a rotational center of the main assembly coupling member when said drive transmission coupling member rotates in the first rotational direction, and a second portion for permitting deviation between the rotational center of said drive transmission coupling member and the rotational center of the main assembly coupling member when said drive transmission coupling member rotates in the second rotational direction.

2. A drive transmission coupling member according to claim 1, wherein the relative positional relation of the drive transmission coupling member relative to the main assembly coupling member is different between when said drive transmission coupling member rotates in the first rotational direction and when said drive transmission coupling member rotates in the second rotational direction.

3. A drive transmission coupling member according to claim 1, wherein said drive transmission coupling member is provided with a first driving force receiving portion for receiving a driving force from the main assembly coupling member and a second driving force receiving portion for receiving a driving force from the main assembly coupling member when it rotates in the second rotational direction.

4. A drive transmission coupling member according to claim 1, wherein a gap in a radial direction between said drive transmission coupling member and the main assembly coupling member is larger when said drive transmission coupling member rotates in the second rotational direction than when said drive transmission coupling member rotates in the first rotational direction.

5. A drive transmission coupling member according to claim 1, wherein said first portion is engaged with the main assembly coupling member.

6. A drive transmission coupling member according to claim 5, wherein the first portion includes a substantially semicircular portion.

7. A drive transmission coupling member according to claim 5, wherein said first portion includes a substantially triangular portion.

8. A process cartridge detachably mountable to a main assembly of an image forming apparatus, comprising:

an image bearing member;

a developing device for developing an electrostatic image formed on said image bearing member with a developer, said developing device including a developer accommodating container, provided with an opening for discharging the developer, a seal member for sealing the opening, a stirring member for stirring the developer in the developer accommodating container, a first driving means for removing the seal member and a second driving means for driving the stirring member;

a rotatable first drive transmission coupling member for receiving a driving force from a first main assembly coupling member provided in the main assembly of the apparatus to transmit the driving force to said image bearing member;

a rotatable second drive transmission coupling member for receiving a driving force from a second main assembly coupling member provided in the main assembly of the apparatus to transmit the driving forces to said first and second driving means;

wherein when said second drive transmission coupling member transmits the driving force to said first driving means to unseal the opening, a rotational center of said second drive transmission coupling member and a rotational center of said second main assembly coupling member are substantially aligned, and the drive transmission between the first drive transmission coupling member and the first main assembly coupling member is disabled, and after the opening is unsealed, said second drive transmission coupling member transmits the driving force to said second driving means, and the rotational center of the second drive transmission coupling member and the rotational center of the second main assembly coupling member are permitted to deviate, and said first drive transmission coupling member receives a driving force from said first main assembly coupling member.

9. A process cartridge according to claim 8, wherein said second drive transmission coupling member transmits the driving force to said first driving means by rotating in a first rotational direction and transmits the driving force to said second driving means by rotating in a second rotational direction which is opposite from the first rotational direction, wherein said second drive transmission coupling member comprises a first portion for substantially aligning a rotational center of said second drive transmission coupling member with a rotational center of the second main assembly coupling member when it rotates in the first rotational direction and a second portion for permitting deviation between the rotational center of said second drive transmission coupling member and the rotational center of the second main assembly coupling member.

10. A process cartridge according to claim 9, wherein the relative positional relation of the second drive transmission coupling member relative to the second main assembly coupling member is different between when said second drive transmission coupling member rotates in the first rotational direction and when said second drive transmission coupling member rotates in the second rotational direction.

11. A process cartridge according to claim 9, wherein said second drive transmission coupling member is provided with a first driving force receiving portion for receiving the driving force from the second main assembly coupling member and a second driving force receiving portion for receiving the driving force from the second main assembly coupling member when said second drive transmission coupling member rotates in the second rotational direction.

12. A process cartridge according to claim 9, wherein a gap in a radial direction between said second drive transmission coupling member and the second main assembly coupling member is larger when said second drive transmission coupling member rotates in the second rotational direction than when said drive transmission coupling member rotates in the first rotational direction.

13. A process cartridge according to claim 9, wherein said first portion is engaged with the second main assembly coupling member.

14. A process cartridge according to claim 13, wherein the first portion includes a substantially semicircular portion.

15. A process cartridge according to claim 13, wherein said first portion includes a substantially triangular portion.

16. An image forming apparatus to which a process cartridge is detachably mountable, said apparatus comprising:

a process cartridge mounting member for mounting said process cartridge, which includes:

an image bearing member;

a developing device for developing an electrostatic image formed on said image bearing member with a developer, said developing device including a developer accommodating container, provided with an opening for discharging the developer, a seal member for sealing the opening, a stirring member for stirring the developer in the developer accommodating container, a first driving means for removing the seal member and a second driving means for driving the stirring member;

a rotatable first drive transmission coupling member for receiving a driving force from a first main assembly coupling member provided in a main assembly of the apparatus to transmit the driving force to said image bearing member;

a rotatable second drive transmission coupling member for receiving a driving force from a second main assembly coupling member provided in the main assembly of the apparatus to transmit the driving forces to said first and second driving means;

said apparatus further comprising:

said first main assembly coupling member for supplying a driving force to said first drive transmission coupling member;

said second main assembly coupling member for supplying a driving force to said second drive transmission coupling member;

wherein when said second drive transmission coupling member transmits the driving force to said first driving means to unseal the opening, a rotational center of said second drive transmission coupling member and a rotational center of said second main assembly coupling member are substantially aligned, and the drive transmission between the first drive transmission coupling member and the first main assembly coupling member is disabled, and after the opening is unsealed, said second drive transmission coupling member transmits the driving force to said second driving means, and the rotational center of the second drive transmission coupling member and the rotational center of the second main assembly coupling member are permitted to deviate, and said first drive transmission coupling member receives a driving force from said first main assembly coupling member.

17. An apparatus according to claim 16, wherein said second drive transmission coupling member transmits the driving force to said first driving means by rotating in a first rotational direction and transmits the driving force to said second driving means by rotating in a second rotational direction which is opposite from the first rotational direction, wherein said second drive transmission coupling member comprises a first portion for substantially aligning a rotational center of said second drive transmission coupling member with a rotational center of the second main assembly coupling member when said second drive transmission coupling member rotates in the first rotational direction and a second portion for permitting deviation between the rotational center of said second drive transmission coupling member and the rotational center of the second main assembly coupling member.

18. An apparatus according to claim 17, wherein the relative positional relation of the second drive transmission coupling member relative to the second main assembly coupling member is different between when said second drive transmission coupling member rotates in the first rotational direction and when said second drive transmission coupling member rotates in the second rotational direction.

19. An apparatus according to claim 17, wherein said second drive transmission coupling member is provided with a first driving force receiving portion for receiving the driving force from the second main assembly coupling member and a second driving force receiving portion for receiving the driving force from the second main assembly coupling member when said second drive transmission coupling member rotates in the second rotational direction.

20. An apparatus according to claim 17, wherein a gap in a radial direction between said second drive transmission coupling member and the second main assembly coupling member is larger when said second drive transmission coupling member rotates in the second rotational direction than when said drive transmission coupling member rotates in the first rotational direction.

21. An apparatus according to claim 17, wherein said first portion is engaged with the second main assembly coupling member.

22. An apparatus according to claim 21, wherein the first portion includes a substantially semicircular portion.

23. An apparatus according to claim 21, wherein said first portion includes a substantially triangular portion.

* * * * *

UNITED STATES PATENT AND TRADEMARK OFFICE

CERTIFICATE OF CORRECTION

PATENT NO. : 6,301,457 B1
DATED : October 9, 2001
INVENTOR(S) : Kazuo Chadani et al.

It is certified that error appears in the above-identified patent and that said Letters Patent is hereby corrected as shown below:

Title page,
Item [57] ABSTRACT,
Line 11, "which" should read -- which is --.

Column 1,
Line 54, "open it." should read -- it open. --.

Column 2,
Line 8, "a two" should read -- two --.

Column 5,
Line 13, "of which is" should read -- which is --.

Column 7,
Line 27, "means" (1st occurrence) should read -- mean --.

Column 11,
Line 5, "the their" should read -- the --.

Signed and Sealed this

Twenty-first Day of May, 2002

*Attest:*

*Attesting Officer*

JAMES E. ROGAN
*Director of the United States Patent and Trademark Office*